US006194080B1

(12) United States Patent
Stickling

(10) Patent No.: US 6,194,080 B1
(45) Date of Patent: Feb. 27, 2001

(54) REPLACEABLE WEAR MEMBER

(75) Inventor: Christopher J. Stickling, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/212,791

(22) Filed: Dec. 16, 1998

(51) Int. Cl.[7] ..... E02F 9/28

(52) U.S. Cl. ..... 428/596; 428/600; 37/455; 296/39.2; 296/41; 172/772

(58) Field of Search ..... 428/596, 600, 428/582; 37/453, 455, 456; 296/39.2, 41; 172/772, 772.5, 749, 753

(56) References Cited

U.S. PATENT DOCUMENTS

| | | |
|---|---|---|
| Re. 33,454 | 11/1990 | Potter . |
| 2,325,991 | 8/1943 | White . |
| 3,912,325 | 10/1975 | Sudyk . |
| 4,029,354 | 6/1977 | Valeri . |
| 4,501,079 | 2/1985 | Hahn et al. . |
| 4,716,666 | 1/1988 | Potter . |
| 4,995,176 | 2/1991 | Briscoe et al. . |
| 5,005,304 | 4/1991 | Briscoe et al. . |
| 5,056,243 | 10/1991 | Sprunger et al. . |
| 5,063,695 | 11/1991 | Briscoe et al. . |
| 5,088,214 | 2/1992 | Jones . |
| 5,129,168 | 7/1992 | Hedley . |
| 5,131,709 | 7/1992 | Spica . |
| 5,185,980 | 2/1993 | Rydberg et al. . |
| 5,241,765 | 9/1993 | Jones et al. . |
| 5,564,508 | 10/1996 | Renski . |
| 5,597,194 | 1/1997 | Daugherty et al. . |
| 5,599,055 | 2/1997 | Brown . |
| 5,913,605 | 6/1999 | Jusselin et al. . |
| 5,937,549 * | 8/1999 | Bender et al. . |

FOREIGN PATENT DOCUMENTS

| | | |
|---|---|---|
| WO 98/44208 | 10/1998 | (WO) . |
| WO 99/23315 | 5/1999 | (WO) . |

* cited by examiner

*Primary Examiner*—Deborah Jones
*Assistant Examiner*—Jennifer McNeil
(74) *Attorney, Agent, or Firm*—O. Gordon Pence

(57) ABSTRACT

A wear protection system is disclosed for protecting a parent member of an earthworking machine, such as a bed of an off-highway truck for instance. The protection system includes a replaceable wear member, which is detachably mounted to a mounting base by a retainer. The wear member is provided with a skeletal frame with a large window-like opening and outstretched legs to reduce the weight of the wear member. The pockets formed by the window opening and in the spaces between adjoining wear members fill with material so as to insulate the parent member of the truck bed from frictional wear due to material sliding over the bed when dumping material therefrom.

23 Claims, 6 Drawing Sheets

REPLACEABLE WEAR MEMBER

TECHNICAL FIELD

This invention relates generally to a wear protection systems for protecting parent members of earthworking machines from abrasive wear and, more particularly, to a replaceable wear member having a skeletal body for weight reduction purposes.

BACKGROUND ART

Replaceable wear members for protecting structural members such as the bowl of a bucket or the bed of truck body are well known in the art. These replaceable wear members come in many different shapes and forms and employ a variety of different attachment methods for securing them to the structural or parent members they protect. For instance, some wear members may be simple strips or plates of steel, which are welded to the structural member. Bolts are also commonly used to secure such wear members. More recently, separate "wear tiles" have been employed, such as the one depicted in U.S. Pat. No. 5,564,508, entitled Replaceable Wear Runner issued Oct. 15, 1996 to William J. Renski and assigned to the assignee hereof.

Prior wear members may be 50 to over 100 mm thick and, because they are steel, are quite heavy and add a significant amount of weight to the truck body or bucket. As a result, the carrying capacity of the truck body or bucket if effectively reduced. Also, the truck bodies of off-highway trucks, for instance, are loaded by large loaders or shovels capable of picking up and then dropping boulder size rocks into the truck body. As such large rocks are dropped from great heights, large impact loads are exerted on the truck bed, creating dents and unevenness in the bed. As a result, the corners or other portions of the wear members become spaced from and unsupported by the bed. When impacted by subsequent rocks, these wear members may themselves break or have securing method fail, resulting in the loss of the wear member.

Accordingly, it would be highly advantageous to employ a wear member that adds less weight to the truck body or bucket, while maintaining its ability to protect the structural members thereof or overcoming one or more of the problems as set forth above.

DISCLOSURE OF THE INVENTION

In one aspect of the invention, a replaceable wear member is provided that includes a skeletal body portion having a continuous peripheral frame extending about a large window-like opening through the body portion.

In another aspect of the invention, a wear protection system is provided for protecting a parent member of an earthmoving machine. The wear protection system includes a mounting base carried on the parent member and a replaceable wear member. The wear member has a skeletal body portion having a continuous peripheral frame extending about a large window-like opening through the body portion. Cooperating place and slide engagement elements are included on each of the mounting base and the wear member, which are adapted to permit place and slide mounting of the wear member onto the mounting base to a mounted position. The wear protection system also includes a retainer adapted to retain the wear member in its mounted position.

BEST MODE FOR CARRYING OUT THE INVENTION

Figure 1:
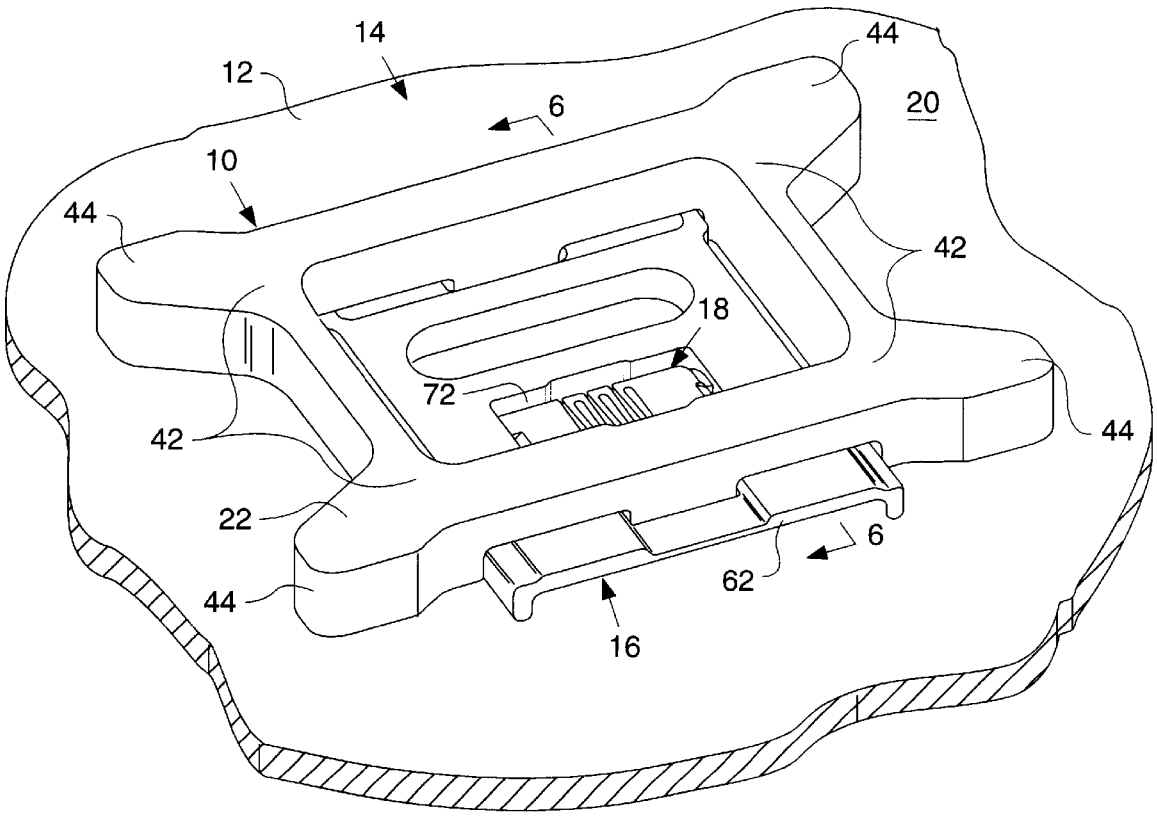
FIG. 1 is a diagrammatic top prospective view of the wear protection system embodying the principles of the present invention.

Referring more particularly to the drawings, a replaceable wear member is generally shown at 10 in FIG. 1 for protecting a parent member 12 of an earthmoving machine (not shown). It is the intent of the present invention that the parent member 12 be any portion of an earthmoving machine exposed to high wear due to working contact with various materials such as dirt, rock, sand, ore and the like. For example, such parent member may be the bed of a dump truck body, or the bowl or other portions of a bucket for excavators, loaders, backhoes, shovels and the like. In the embodiment shown in the drawings and described herein for illustrative purposes, the parent member 12 is the bed of an off-highway truck (not shown).

Figure 5:
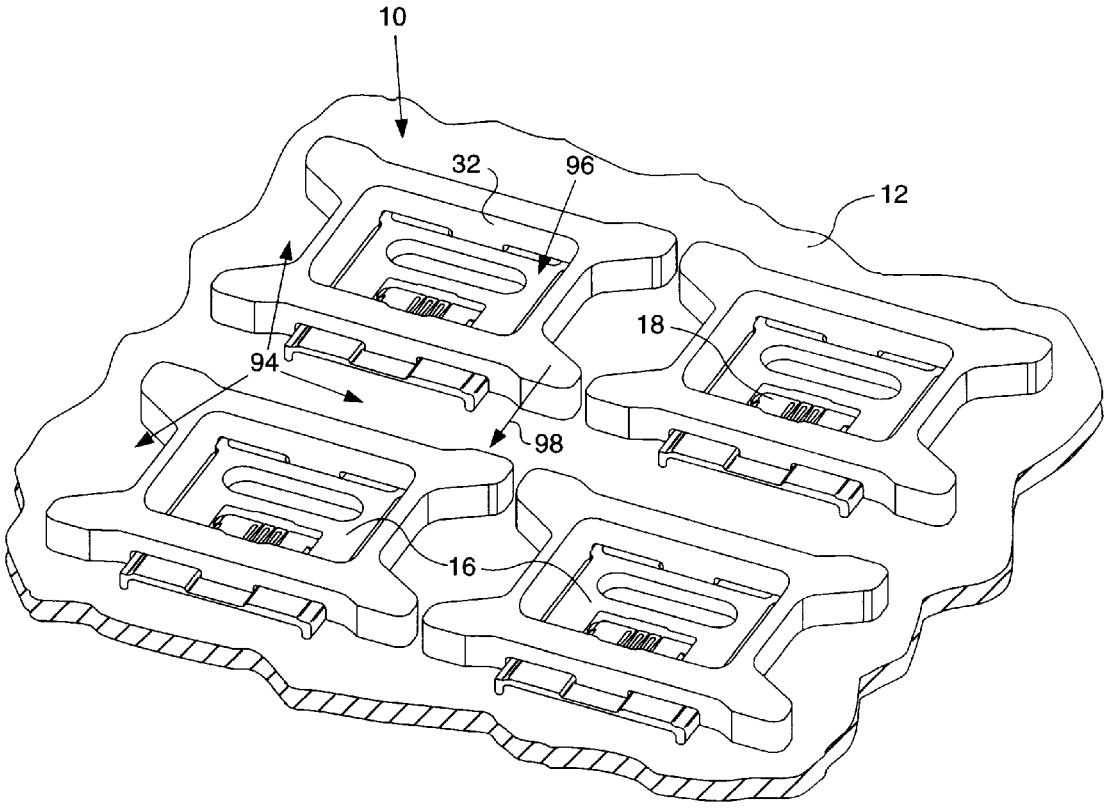
FIG. 5 is a diagrammatic top prospective view of a reduced size illustrating several wear members arranged in a particular pattern on a bed of a truck body.

The wear member 10 is part of a wear protection system 14, which also includes a mounting base 16 and a retainer 18 for mounting the wear member 10 to a surface 20 of the parent member 12 to be protected, i.e., the truck bed. It should be noted that a plurality of such wear members 10 may be mounted on the surface 20 in a particular arrangement, such as shown in FIG. 5, as discussed in greater detail below. The retainer 18 shown herein is of the type depicted in co-pending U.S. patent application Ser. No. 8/825,822, filed Mar. 31, 1997, entitled Wear Member Attachment System, which application is assigned to the Assignee hereof and is incorporated herein by this reference. Retainer has a central convoluted spring portion 19 that enables the retainer to be compressed in its lengthwise direction. It should also be noted that the present invention is not intended to be limited to any particular type or style of retainer, as those skilled in the art can readily adapt the present wear protection system to accept other types of retainers as well.

Figure 2:
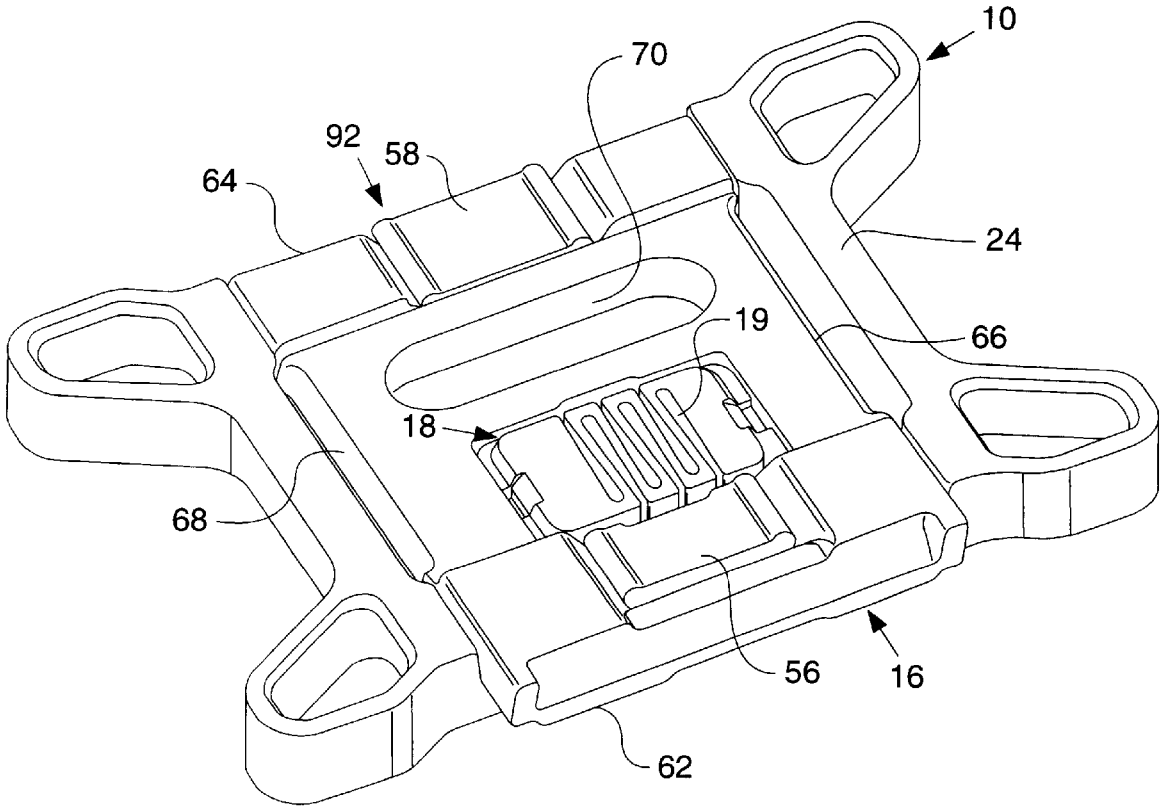
FIG. 2 is a diagrammatic bottom prospective view of the wear protection system illustrated in FIG. 1.
Figure 3:
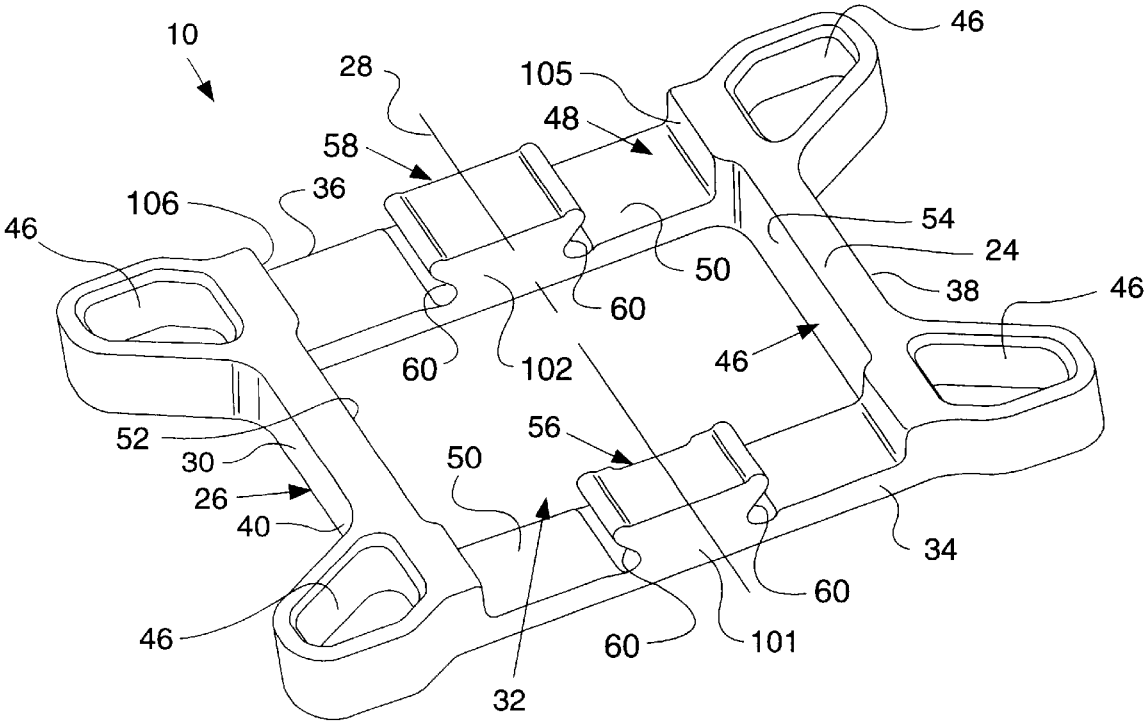
FIG. 3 is a diagrammatic bottom prospective view similar to FIG. 2, but showing only the wear member of the wear protection system of the present invention.

The replaceable wear member 10 is preferably of a steel casting and has an outer wear exposed side 22 (FIG. 1) and an opposite inner mounting side 24 (FIG. 2). As best shown in FIG. 3, the wear member 10 is provided with a skeletal body portion 26 disposed along a central axis 28. The skeletal body portion 26 has a continuous peripheral frame 30 extending about a large window-like opening 32 through the body portion. The frame 30 preferably has a generally rectangular configuration having a first pair of spaced apart rails 34,36 transverse to the central axis and a second pair of spaced apart rails 38,40 disposed in spaced parallel relation to the central axis 28. Each end of the first pair of rails 34,36 is joined at a respective corner 42 (FIG. 1) to respective ends of the second pair of rails 38,40.

The frame 30 also includes four outstretched leg portions 44. Each leg portion 44 extends laterally outwardly from a respective one of the corners 42. Each of the leg portions 44 has a recessed pocket 46 (FIG. 3) in the inner mounting side surface 24 thereof.

The inner mounting side 24 of the frame 30 also has a recessed channel 48 therein providing a recessed mounting surface 50. Channel 48 extends through each of the first rails 34,36 and has pair of opposing sidewalls 52,54 that extend along a respective one of the second rails 38,40. The sidewalls 52,54 are disposed a predetermined distance apart and are oriented parallel to the central axis 28. Channel 48 in effective in providing at least a portion of the first pair of rails 34,36 with a reduced thickness and a uniform width-wise cross-section so that such portion of the rails is flexible and has the characteristics of a bending beam. In effect, the first pair of rails 34,36 respond as a spring in their lengthwise direction.

A pair of dovetail members 56,58 are located in the channel 48, each projecting from one of the first rails 34,36 and disposed on opposite sides of the window-like opening 32. Each dovetail member 56,58 has a pair inwardly beveled surfaces 60 thereon.

In the present embodiment, the frame 30 has a thickness between the inner and outer sides of about 35 mm. Also, the outer wear exposed side 32 of the frame 30 of the wear member 10 defines a predetermined surface area. The window-like opening 32 has an area of at least one-half the predetermined surface area of the frame 30. More preferably, the window-like opening 32 is sized to provide an area that is greater than 75% of the predetermined surface area of the frame.

Figure 4:
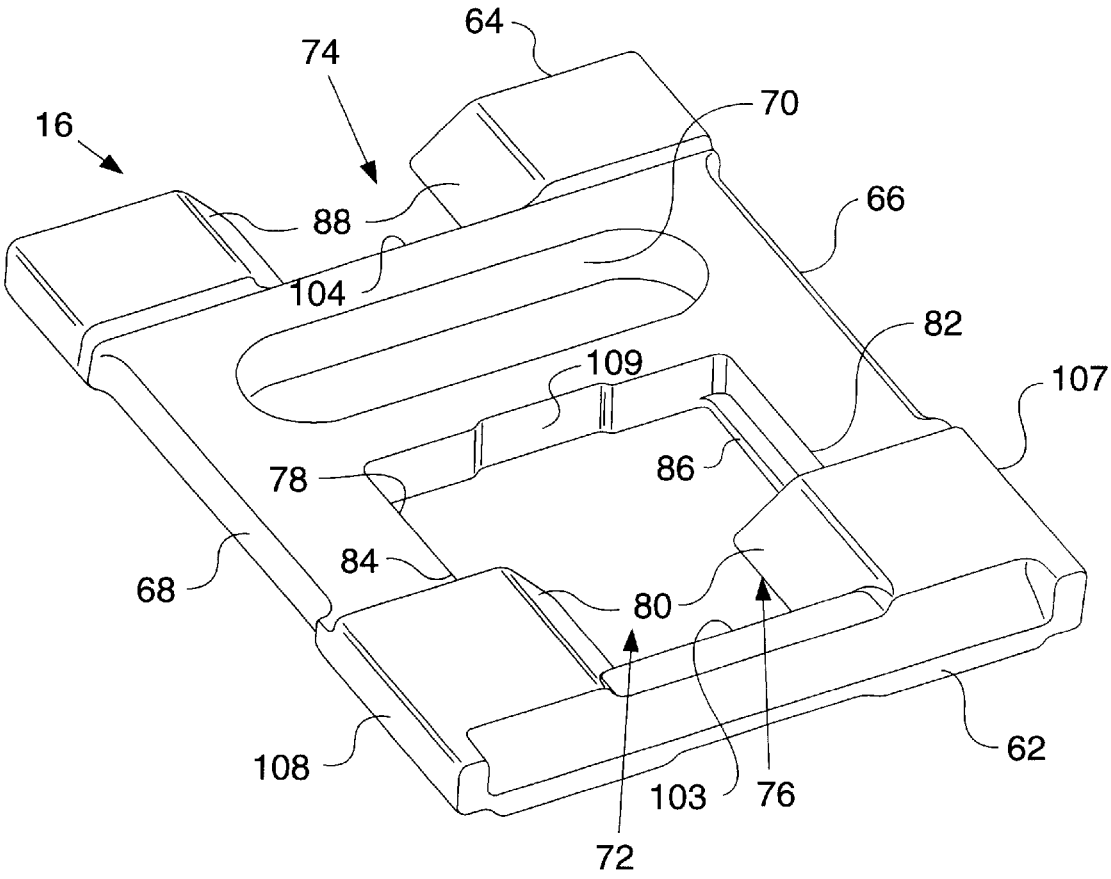
FIG. 4 is a diagrammatic bottom prospective view showing only the mounting base of the present invention.

As best seen in FIG. 4, the mounting base 16 of the wear protection system 14 is generally planar and has a trailing edge 62 and an opposite leading edge 64 and opposite sides 66,68. The mounting base is construct ed of steel and is suitably attached to the parent member, preferably by welding within a weld opening 70 and along the trailing edge 62. In the present embodiment, the mounting base has a thickness of about 16 mm. The mounting base 16 also has a mounting opening 72 of a generally "T"-shaped configuration disposed adjacent the trailing edge 62 and an open mounting slot 74 disposed at the leading edge. The mounting opening 72 has a dovetail portion 76 on the trailing edge side and a retainer portion 78 on the leading edge side. The dovetail portion 76 is provided with a first pair of internal dovetail surfaces 80 therein and an end defining an abutment surface 103. The retainer portion 78 has opposite ends 82,84, each of which is provided with an inwardly extending flange or catch element 86. The retainer portion also has a side facing toward the trailing edge 62, which defines an abutment surface 109. The open slot 74 at the leading edge 64 is provided with a second pair of internal dovetail surfaces 88 therein. The open slot also has an end facing the leading edge side, which defines another abutment surface 104.

The above described elements provide cooperating place and slide engagement elements 92 (FIG. 2) on each of the mounting base 16 and the wear member 10, which are adapted to permit place and slide mounting of said wear member 10 onto the mounting base 16 to a mounted position shown in FIGS. 1 & 2. Such cooperating place and slide elements include the mounting base receiving channel 48 in and dovetail members 56,58 on the wear member 10 and dovetail surfaces 80,88 in the mounting opening 72 and the open slot 74, respectively, of the mounting base 16.

Industrial Applicability

The present wear protection system 14 provides several advantages. The main advantage of the system 14 is that it is much lighter in weight than prior systems. Being lighter means that the weight of the machine, i.e., truck, is not increased as much by the addition of the present wear protection system as compared to prior known systems. Thus, the truck's payload is greater than with prior, heavier protection devices. The lighter weight is provided by the skeletal construction of the wear member 10, which, with the outreach of the leg portions 44 at the corners 42, provides the same coverage of the truck bed surface as the prior devices. When such skeletal wear members 10 are arranged on the truck bed in a spaced apart pattern, such as shown in FIG. 5, it can be noted that a plurality of pockets 94 are formed between adjoining wear members 10. The window-like openings 32 also provide similar pockets 96. During loading of the truck body with dirt or other materials being carried by the truck, these pockets 94,96 will become filled with material or its fines. After being transporting by the truck to the desired dumpsite, the front end of truck body is raised to dump the material out the back end of the body. As the material is being dumped, it slides across the bottom of the bed 12 in a direction indicated by arrow 98. By limiting the size of the pockets 94,96 in the direction of material movement to a dimension within a range of about 100 mm to 150 mm, it has been found that the material captured in the pockets will remain there as the rest of the material is being dumped. As a result, the truck bed is at least partially insulated from frictional wear due to the sliding movement of the material as it is being dumped from the truck bed by the material that is captured in the pockets 94,96.

In the present embodiment, the wear member 10 has an overall length of about 310 mm and an overall width of about 200 mm, as measured from one leg tip to the respective opposite leg tip. This provides a bed coverage area of about 62,000 $mm^2$. The actual projected surface area of the wear member 10, on the other hand, is about 20,000 $mm^2$. As a consequence, only about one-third of the bed area is actually covered by the wear member 10, the remaining two-thirds of the coverage area being open space provided by the window-like opening 32 and the pockets provided between the leg portions 44. When the wear members 10 are arranged in a spaced apart pattern, as depicted in FIG. 5, the bed area actually covered by steel, i.e., the surface area afforded by the wear members 10, is reduced to about 15–20% of the total bed area covered by the wear members. As will be appreciated, this results in a significant weight reduction over the "solid" wear tiles employed previously.

Another advantage of the present invention is the ability of the wear member 10 to flex or bend when impacted by large rocks and the like. In particular, rails 34,36 are designed with a thinner and uniform width-wise cross-section so as to provide such rails with the characteristics of a bending beam. The flexibility afforded by this construction allows the use of the less rigid, skeletal construction in the present wear member 10. This reduces the structure required for strength found in prior devices, enabling the wear member to be much lighter and produce less throw-away material.

Another advantage of the present invention is the quick and simple mounting of the wear member 10 onto the mounting base 16 and its subsequent removal, even in the worst of packing conditions. The installation may be accomplished without special tools other than a common screwdriver or small pry bar and without any excessive amount of force being required. The place and slide arrangement 92 allows the wear member 10 to be placed on the mounting base 16, with the mounting base 16 being received in the channel 48 and with the trailing dovetail member 56 being situated in the retainer portion 78 of the mounting opening 72 and the leading dovetail member 58 being situated next to the open end of the open slot 74. The wear member 10 is then slid into its mounted position where the cooperating place and slide engagement elements 92 become engaged to hold the wear member 10 onto the mounting base 16. Such engagement elements include the dovetail members 56,58 on the wear member 10 and the dovetail surfaces 80,88 on the mounting base 16 that the dovetail members 56,58 engage when the wear member 10 is in its mounted position. Once in the mounted position, the retainer 18 may be inserted into the retainer portion 78 of the mounting opening 72 by placing one end of the retainer under one of the flanges or catch elements 84 and the other end above the other flange. A pry bar may then be used to compress the retainer 18 in length sufficiently for the free end of the retainer 18 to clear the other flange 84 and allow the retainer 18 to become fully seated within the retainer portion 78 of mounting opening 72. It should be noted that the convoluted spring portion 19 of the retainer 18 is adapted to allow the retainer 18 to be sufficiently compressed in its lengthwise direction to permit its insertion passed the catch elements 84 into the retainer portion 78 of the mounting opening 72. Once located in the retainer portion 78, the retainer re-expands to its non-compressed length whereby the retainer 18 is engaged and retained by the catch elements so as to prevent its escape form the retainer portion 78 of the mounting opening 72. Removal of the retainer 18 is accomplished by reversing the preceding procedure.

Figure 6:
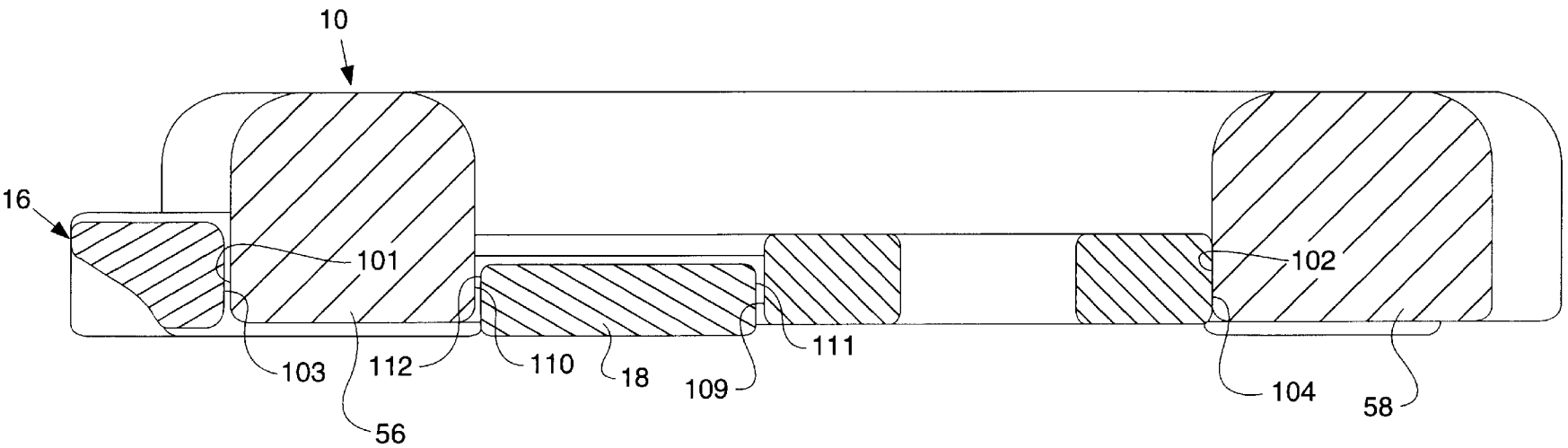
FIG. 6 is a cross-sectional view of the wear protection system taken generally along line 6—6 of FIG. 1.

When the wear member 10 is in its mounted position though, first and second abutment surfaces 101,102 on the wear member, as shown in FIG. 6, are disposed to abut with third and fourth abutment surfaces 103,104 on the mounting base to limit movement of the wear member 10 in one direction along the central axis. Such first and second abutments 101 and 102 are preferably provided by a one of the ends of each of the respective the dovetail members 56,58 of the skeletal body portion 26. The third and fourth surfaces 103,104 are preferably provided by one end of the dovetail portion 76 of the mounting opening 72 and the end of the open mounting slot 74.

As shown in FIG. 3, each of the opposing side walls 52,54 of channel 48 of the wear member 10 provide one of a respective a fifth and sixth abutment surfaces 105,106 thereon that are oriented parallel to said central axis 28. Each of the opposite sides 66,68 of the mounting base 16 define one of a seventh and eighth abutment surfaces 107,108, which are adapted to abut a respective one of the fifth and sixth abutments surfaces 105,106 on the wear member 10 so as to limit movement of the wear member laterally of the central axis 26 when the wear member 10 is in its mounted position.

One side of the retainer portion 78 of the mounting opening 72 in the mounting base 16 defines a ninth abutment surface 109 thereon, while an opposing end of the dovetail member 56 received in the first pair of dovetail surfaces 80 provides a tenth abutment surface 110 thereon disposed in spaced opposing relation to said ninth abutment surface 109. When the retainer 18 is seated in the retainer portion 78 of the mounting opening 72, a respective one of the opposite sides of the retainer 18 define one of an eleventh and twelfth abutment surfaces 111,112. When the wear member 10 is in its mounted position, the eleventh abutment surface 111 abuts the ninth abutment surface 109, while the twelfth abutment surface 112 abuts the tenth abutment surface 110. Thus, movement of the wear member is prevented in a direction opposite to the first direction.

While the invention has been illustrated and described in detail in the foregoing drawings and description with respect a specific preferred embodiment thereof, such illustration and description is to be considered as exemplary and not restrictive. It should be understood that there is no intent to limit the invention to the particular form disclosed, but on the contrary, the intention is to cover all modifications, equivalents, and alternatives falling within the spirit and scope of the invention as defined by the appended claims.

What is claimed is:

1. A replaceable wear member, comprising:

a skeletal body portion having a continuous peripheral frame extending about and defining a large window opening through said body portion.

2. The wear member of claim 1 including an outer wear exposed side and an opposite inner mounting side, said inner mounting side having a recessed channel having a pair of dovetail members projecting therefrom and disposed on opposite sides of said window opening.

3. The wear member of claim 2 wherein each dovetail member has a pair inwardly beveled surfaces thereon.

4. The wear member of claim 3 wherein said skeletal body portion is disposed along a central axis and said frame has a generally rectangular configuration having a first pair of spaced apart rails transverse to said central axis and a second pair of spaced apart rails disposed in spaced parallel relation to said central axis, each of the first pair of rails being joined at a respective corner to respective ones of said second pair of rails.

5. The wear member of claim 4 wherein each of said dovetail members has one of a first and second abutment surfaces normal to said central axis, and wherein said channel has opposite sidewalls, each sidewall having one of a third and fourth abutment surfaces thereon oriented parallel to said central axis.

6. The wear member of claim 5 wherein said frame includes four leg portions, each leg portion extending laterally outwardly from a respective one of said corners formed by said rails.

7. The wear member of claim 6 wherein each of said leg portions have a recessed pocket in the inner mounting side surface thereof.

8. The wear member of claim 7 wherein said frame has a thickness between said inner and outer sides, said thickness being at least 25 mm.

9. The wear member of claim 8 wherein the outer side of said frame defines a surface area and wherein said window opening has an area of at least one-half said surface area of said frame.

10. The wear member of claim 9 wherein said area of said window opening is greater than 75% of said surface area of said frame.

11. The wear member of claim 10 wherein said wear member is a steel casting.

12. A wear protection system for protecting a parent member of an earthmoving machine, comprising:

a mounting base carried on said parent member;

a replaceable wear member, said wear member having a skeletal body portion, said skeletal body portion having a continuous peripheral frame extending about and defining a large window opening through said body portion;

cooperating place and slide engagement elements on each of said mounting base and said wear member adapted to permit place and slide mounting of said wear member onto said mounting base to a mounted position; and a retainer adapted to retain said wear member in said mounted position.

13. The wear protection system of claim 12 wherein said cooperating place and slide engagement elements include a pair of dovetail members on said wear member and a first and second pair of internal dovetail surfaces on said mounting base, said first pair of internal dovetail surfaces being adapted to receive one of said dovetail members and said second pair of internal dovetail surfaces being adapted to receive the second of said dovetail portions of the wear member when said wear member is in its mounted position.

14. The wear protection system of claim 13 wherein said skeletal body portion is disposed along a central axis and said frame has a generally rectangular configuration having a first pair of spaced apart rails transverse to said central axis and a second pair of spaced apart rails disposed in spaced parallel relation to said central axis, each of the first pair of rails being joined at a respective corner to respective ones of said second pair of rails.

15. The wear protection system of claim 14 wherein said wear member has an outer wear exposed side and an opposite inner mounting side, said inner mounting side having a recessed channel with said a pair of dovetail members projecting therefrom and disposed on opposite sides of said window-like opening.

16. The wear protection system of claim 15 wherein said mounting base has opposite edges, a mounting opening disposed adjacent one of said edges and an open mounting slot disposed at the other of said edges, said mounting opening having said first pair of dovetail surfaces therein and said mounting slot having said second pair of dovetail surfaces therein.

17. The wear protection system of claim 16 wherein each of said dovetail members of said wear member have one of a first and second abutment surfaces normal to said central axis, and wherein mounting base has a third and a fourth abutment surface, said first and second abutment surfaces being adapted to abut said third and fourth abutment surfaces, respectively, to limit movement of said wear member in one direction along said central axis when said wear member is in its mounted position.

18. The wear protection system of claim 17 wherein said recessed channel of said wear member has a pair of opposing sidewalls, each sidewall having one of a fifth and sixth abutment surfaces thereon oriented parallel to said central axis, and wherein said mounting base has opposite sides, each side defining one of a seventh and eight abutment surfaces adapted to abut a respective one of said fifth and sixth abutments surfaces on said wear member so as to limit movement of said wear member laterally of said central axis when said wear member is in its mounted position.

19. The wear protection system of claim 18 wherein said mounting opening in the mounting base has a retainer portion defining a ninth abutment surface thereon and said dovetail member received in said first pair of dovetail surfaces has a tenth abutment surface thereon disposed in spaced opposing relation to said ninth abutment surface, and wherein said retainer has opposite sides each defining one of an eleventh and twelfth abutment surfaces, said retainer being positionable within said retainer portion of said mounting opening when said wear member is in its mounted position wherein said eleventh abutment surface abuts said ninth abutment surface and said twelfth abutment surface abuts said tenth abutment surface whereby movement of said wear member is prevented in a direction opposite to said one direction.

20. The wear protection system of claim 19 wherein said wear member is a steel casting.

21. The wear protection system of claim 20 wherein said retainer has a convoluted spring portion.

22. The wear protection system of claim 21 wherein said retainer portion of said mounting opening has a catch element at each end thereof and wherein said spring portion of said retainer is adapted to allow the retainer to be sufficiently compressed from a noncompressed length to permit its insertion past said catch elements into said retainer portion of said mounting opening, whereby said retainer is engaged and retained by said catch elements when at its noncompressed length so as to prevent the retainer's escape from the retainer portion.

23. A replaceable wear member, comprising:

a skeletal body portion disposed along a central axis and having an inner mounting side;

a continuous peripheral frame extending about and defining a large window opening through said body portion, said frame having a first pair of spaced apart rails extending in a transverse direction to said central axis; and a recessed channel in the inner mounting side of said body portion, said channel extending through each of the first rails, whereby at least a portion of said first pair of rails has a reduced thickness and a uniform width-wise cross-section so that such portion of the rails is flexible and has the characteristics of a bending beam.

* * * * *